United States Patent [19]

Chalabian

[11] Patent Number: 4,576,271

[45] Date of Patent: Mar. 18, 1986

[54] COIN OPERATED PULL-DOWN DOOR AND DOOR SPRING MECHANISM FOR VENDING MACHINE

[75] Inventor: Jack S. Chalabian, Huntington Beach, Calif.

[73] Assignee: K-Jack Engineering Company, Inc., Gardena, Calif.

[21] Appl. No.: 520,718

[22] Filed: Aug. 5, 1983

[51] Int. Cl.[4] ..... G07F 5/08

[52] U.S. Cl. ..... 194/233; 49/386

[58] Field of Search ..... 194/1 G, 1 K, 55, 57, 194/59, DIG. 2; 49/386; 16/72, 80

[56] References Cited

U.S. PATENT DOCUMENTS

| | | | |
|---|---|---|---|
| 3,704,550 | 12/1972 | Hancock | 49/386 |
| 3,884,330 | 5/1975 | Chalabian | 194/59 |
| 3,884,337 | 5/1975 | Voegeli | 194/59 |
| 4,183,426 | 1/1980 | Chalabian | 194/67 |
| 4,377,228 | 3/1983 | Ostermann | 194/1 G X |

*Primary Examiner*—F. J. Bartuska

*Attorney, Agent, or Firm*—Beehler, Pavitt, Siegemund, Jagger & Martella

[57] ABSTRACT

A coin operated pull down door mechanism for a vending machine is disclosed having a latch mounted to the door above a coin receiving and sorting mechanism, a coin seat disposed underneath the coin mechanism, a rod mounted for normally yielding to a camming surface on the door latch when an attempt is made to open the door, and a lever cooperating with coinage wedged by the coin mechanism against the coin seat so as to urge the rod into engagement with the camming surface to thereby bias the latch out of locking engagement with the keeper, allowing opening of the door. Also disclosed is a door return spring mechanism for a vending machine.

24 Claims, 7 Drawing Figures

18
20
22
24
26
28
30
34
36
42
44
50
52
54
56
58
60
68
70
76
92
94
98
100
102

20
26

134
115
64
30
116
120
124
112
38
18
114
138
118
116
128
136
126
33
132
130
118
28
122
22

COIN OPERATED PULL-DOWN DOOR AND DOOR SPRING MECHANISM FOR VENDING MACHINE

BACKGROUND OF THE INVENTION

1. Field of the Invention

The present invention relates generally to coin operated vending machines and particularly newspaper vending machines of the type which are mechanically actuated in accordance with the diameter of coins inserted thereinto. More particularly, the invention is directed to a coin operated vending machine having an access door which is opened by pulling down on the same and a coin mechanism adapted to operate with such an axis door. Also disclosed is a door return spring mechanism suitable for a vending machine having a pull-down access door.

2. State of the Prior Art

Coin operated vending machines having an enclosure for storage of articles to be vended, a lockable door to the enclosure and a coin operated mechanism for unlocking the access door when a predetermined combination of coins is placed in the coin operated mechanism are well known in the art, as disclosed for example in my U.S. Pat. Nos. 3,884,330 and 4,183,426.

Newspaper vending machines are often stand-alone devices supported by legs or a pedestal at relatively low height, typically at waist level.

Since the front access door is also used to load the newspapers or other items to be vended by the operator of the device, operator convenience has in the past taken priority over the convenience of the customers. It is easier to load stacks of relatively heavy and bulky newspapers, if the open door is above the access opening and the articles can be lifted from the ground to a height level with the front opening in the vending machine and placed inside, rather than having to be lifted over an open pull-down door and then introduced into the vending machine. The general practice in the past has therefore been to construct newspaper vending machines with a front access door which is hinged at its upper edge and is opened by pulling up on the door so as to lift its lower edge. The result is that the customer must strain to reach under open door into the interior of the vending machine's enclosure to remove the article purchased. Recent advances in the design of vending machines, however, have overcome this source of difficulty. Namely, the advent of modular vending machines where the coin mechanism, coin box, access door and locking mechanism are all mounted to a frame so as to form a unitary module readily removable by an operator from the enclosure in which are stacked the newspapers to be vended. A service operator removes the door and coin mechanism module from the enclosure in order to retrieve coins deposited by prior customers from a receptacle which is only accessible by removal of the module, thereby making the device highly secure against break-in and theft. The loading of articles is also greatly facilitated since the entire front of the enclosure is fully open.

It has therefore become desirable to provide a coin operated vending machine with a pull-down door mechanism for easier customer access to the articles vended by the machine. U.S. Pat. No. 4,183,426 issued to this applicant discloses a vending machine is of the pull-up door type in which a coin selecting mechanism cooperates with a latch member located underneath the coin mechanism so as to unlock the door when the proper combination of coins has been deposited into the device. The coin selecting mechanism is in part gravity operated so that its orientation in the machine must remain vertical with the coins being inserted near the top of the coin mechanism. The coin selecting device includes a coin chute for retaining a plurality of coins in a columnar relation and a plurality of pawls positioned for movement into the coin chute to engage the uppermost of the coins in the chute so as to prevent upward movement of the coins in the chute when the correct combination of coins has been inserted. The latch member includes a cam surface which contacts the lowermost coin in the chute when an attempt is made to open the door, and as a result the latch is biased out of engagement with the keeper to allow opening of the door. In the vending machine of the prior art, the door is hinged at its upper edge and the latch member is affixed to the door near its lower edge so that when the door is closed, the latch member is positioned underneath the coin mechanism where the cam surface on the latch engages the lowermost coin which partially protrudes from the lower end of the coin chute so that camming engagement takes place to release the latch. The latch is so constructed so as to permit a limited opening movement of the door before the latch member engages the keeper member to lock the door against further opening. This limited displacement of the latch with the door moves the camming surface on the latch past the bottom of the chute of the coin mechanism. If a coin is wedged at the bottom of the chute against the camming surface, camming action occurs and the door is unlocked. If no wedged coins are present, the latch engages the keeper member to actuate the coin reject mechanism. The reject mechanism is actuated whenever an attempt is made to open the door, in the absence of coins wedged by the coin mechanism against the camming surface on the latch member.

It will be readily apparent that the aforedescribed mechanism is dependent on the door being hinged at the top and the latch member being affixed near the lower end of the axis door. A need exists therefore for a mechanical coin selecting mechanism and releasable locking mechanism adapted to a vending machine with a pull down door.

SUMMARY OF THE INVENTION

The present invention is therefore a coin operated pull-down door mechanism for a vending machine comprising a frame, which may be a modular frame constructed and dimensioned to be removably mounted to an enclosure of a vending device, and a door having a lower edge hingedly mounted to the frame for movement between a closed position and an open position. A latch member is affixed to an upper portion of the door and is releasably engageable to a keeper element for normally locking the door to the frame. When a customer attempts to open the door, a limited opening movement is allowed by the latch member mounted near the upper edge of the door.

A coin receiving and selecting mechanism is mounted to the frame below the latch member. Latch release means are provided which include a coin seat disposed under the coin receiving and sorting mechanism. The coin mechanism includes coin sorting means which is operative for wedging proper coinage against the coin seat of the latch release means, thereby enabling the latch release means to release said latch as a consumer attempts to open the door.

The coin receiving and selecting mechanism also includes a coin reject mechanism for returning improper coinage to the customer via a return opening. The keeper member engageable by the latch member is mounted to the upper end of the coin receiving and selecting and is part of the coin reject mechanism. The keeper member actuates the coin reject mechanism in response to pulling force transmitted through the latch to the keeper whenever an attempt is made to open the door, unless the proper coinage has been deposited and is wedged against the coin seat means under the coin sorting mechanism so that the latch release means moves the latch member out of engagement with the keeper to allow opening of the access door.

The construction and operation of the coin receiving and sorting mechanism will be understood by reference to my disclosure in U.S. Pat. No. 4,183,426.

The invention in a presently preferred embodiment further comprises a plunger mounted to the frame and spring-loaded against the door towards an extended position. When the door is closed against the frame, the plunger is held in a depressed position and released as the door is opened. A lever bar is pivotably mounted to the plunger and carries at one end the coin seat which is disposed underneath the bottom of the chute of the coin selecting mechanism when the plunger is depressed. When the access door is fully opened the coin seat is carried by the plunger, out from under the coin mechanism, allowing the coins wedged against the coin seat to fall into an underlying coin box.

The latch release means may further comprise a rod member movable relative to the frame and resting on the end of the lever bar opposite to the coin seat. The rod normally yields to a camming surface on the latch member when an attempt is made to open the access door, allowing the latch to engage the keeper to lock the door. The rod yields to the cam surface on the latch by depressing the pivotable lever bar and thus lifting the coin seata at the opposite end of the bar. If, however, coinage sorted by the receiving and selecting mechanism is wedged against the coin seat, the rod is unable to yield to the camming surface and thus positively engages the camming surface to move the latch member out of engagement with the keeper, allowing the door to be fully opened.

Another aspect of the present invention is directed to a novel door return spring mechanism for a door hinged to a frame for movement between an open and a closed position. The door srping mechanism comprises a side wall surface on the frame, the wall surface being perpendicular to the hinge access of the door and a first member, slidable, along a fixed direction on the wall surface. A spring is mounted between the frame and the slidable member so that the spring is stretched by movement of said member. A rail guide is fixed to the slidable first member at an angle thereto and is also parallel to the wall surface. An arm extends from the door and has an end which is captive for movement along the guide rail. The slidable member, the guide rail and the arm are constructed and configured such that opening movement of the door and the consequent arcuate motion of the captive arm end relative to the frame is resolved into motion of the captive arm end along the guide rail and sliding movement of the slidable first member against the spring, such that the spring urges the door towards its closed position through the sliding assembly comprised of the first member and the guide rail and through the arm captive to the guide rail at one end.

These and other characteristics of the present invention are better understood by reviewing the following Figures, which are presented for the purpose of illustration only and not limitation, wherein like elements are referenced by like numerals, in light of the detailed description of the preferred embodiments.

DETAILED DESCRIPTION OF THE PREFERRED EMBODIMENT

Figure 1:
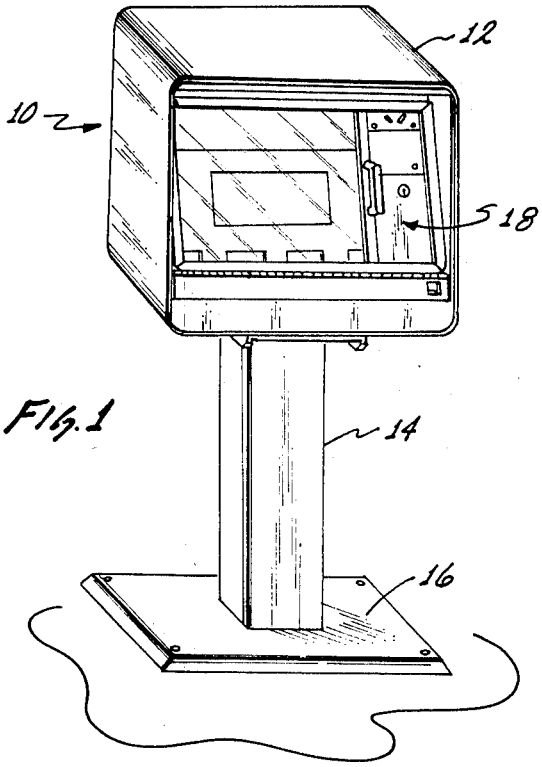
FIG. 1 shows a typical pedestal mounted newspaper vending machine incorporating the pull down door mechanism of this invention.
Figure 2:
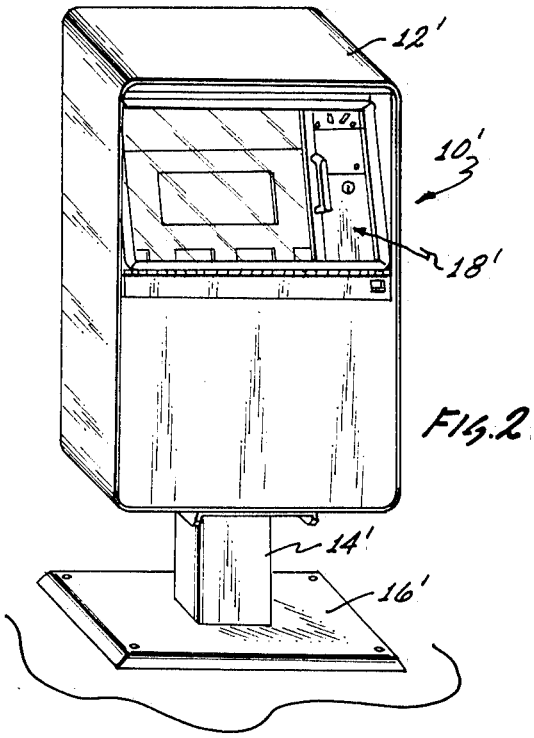
FIG. 2 illustrates a pedestal supported newspaper vending machine with an enlarged enclosure for increased newspaper storage capacity.

Referring to the drawings and FIG. 1 in particular, a newspaper vending machine 10 includes a generally rectangular enclosure 12 supported on a pedestal 14 and a base 16 which may be anchored to a ground surface. A door module 18 fits into the front of the enclosure 12 so as to close access to the interior of the enclosure unless the door mechanism is operated by first depositing a predetermined combination of coins thereinto. FIG. 2 illustrates a similar vending machine 10' supported on a pedestal 14' and base 16', but having an enclosure 12 elongated in the vertical direction so as to provide additional capacity for storage of newspapers, which is useful when vending extra thick issues, e.g. the Sunday edition of a newspaper. The access door module 18 of the vending machine 10' is interchangeable with the door module 18 of the smaller version of the vending machine in FIG. 1.

Figure 3:
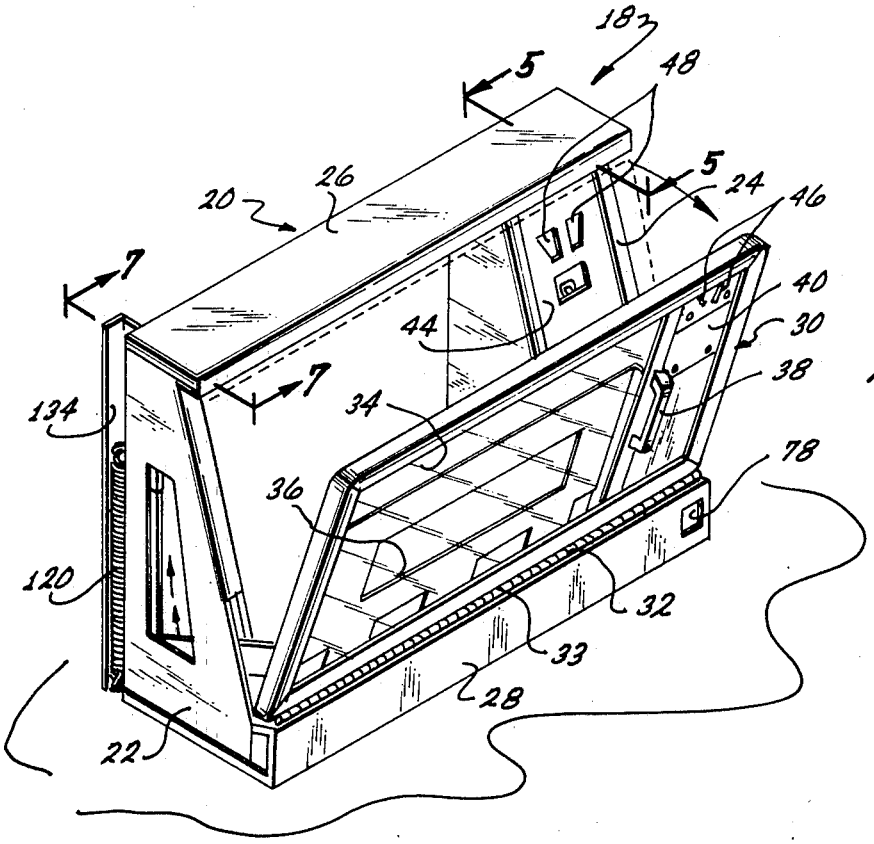
FIG. 3 is a perspective view of a door and coin mechanism module removed from the pedestal mounted enclosures of FIGS. 1 and 2.

The access door module 18 is better seen removed from the enclosure 12 in FIG. 3. The module comprises a frame 20 which is generally trapezoidal in end 22 and includes a door spring mechanism 22 connected to a coin mechanism housing 24 by a top member 26 and a bottom member 28. An access door 30 is hinged along its lower edge 32 to the frame 20 by hinge 33 for movement between a close position suggested in dotted lines and an open position shown in solid lining. The door comprises a translucent window 34 behind which is mounted a bracket 36 for supporting a display copy of the newspaper against the window 34. A handle 38 is mounted to the front surface of the door 30 by which a customer pulls open the door. The access door also includes a coin plate 40 which overlies the front panel 44 of the coin mechanism housing 24.

Figure 4:
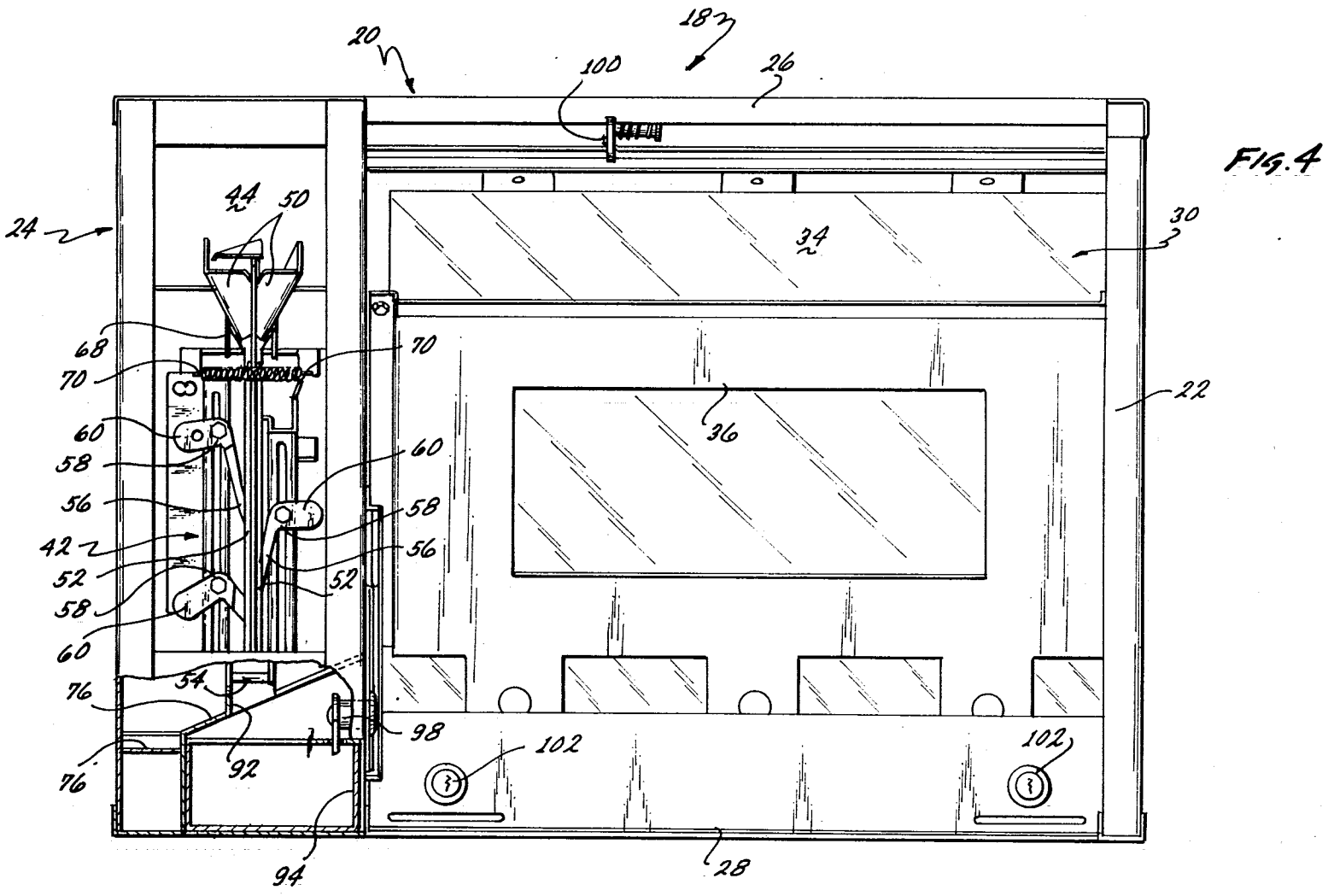
FIG. 4 is a rear view of the mechanism of FIG. 3.

Turning now to FIG. 4, the module 18 is seen in rear view. The back plate normally closing the rear of the coin mechanism housing 24 has been removed to show the coin receiving and sorting mechanism 42 which is a unit detachably mounted to the front panel 44 of the coin mechanism housing 24. A detailed explanation of the operation and manner of removably mounting the coin mechanism 42 is explained in my U.S. Pat. No. 4,183,426, and need not be repeated here. Briefly, coins are inserted through coin slots 46 in the door 30 and aligned openings 48 in the front panel 44 of the coin mechanism housing 24. The coins are received by coin funnels 50 and pass into the coin chutes 52. The coins within the coin chutes are positioned in a columnar edge-to-edge relation with the lowermost coin or coins resting on the upper surface of a pivot bar lever 54. During the passage of the coins through coin chutes 52, the coins contact the pawl fingers 56 of selected pawls 58 whose fingers extend through a slot into the coin chutes 52. The pawls are pivotally mounted so that as the coins pass through the coin chutes, the pawl fingers 56 are moved out of the coin chutes 20 by the weight of the coins to allow passage of the coins. After the coins have passed by the pawl fingers 56, the pawls 58 may then undergo rotation through the force provided by counterweights 60 such that the pawl fingers again extend into the coin chutes 52.

When the proper combination of coins has been inserted into the coin chutes 52, as required for the purchase of a single newspaper, the coins are positioned in a columnar arrangement within the coin chutes. The uppermost coin in the column is positioned immediately below a pawl finger 56 such that the pawl finger prevents upward movement of the coins within the coin chute 52.

Figure 5:
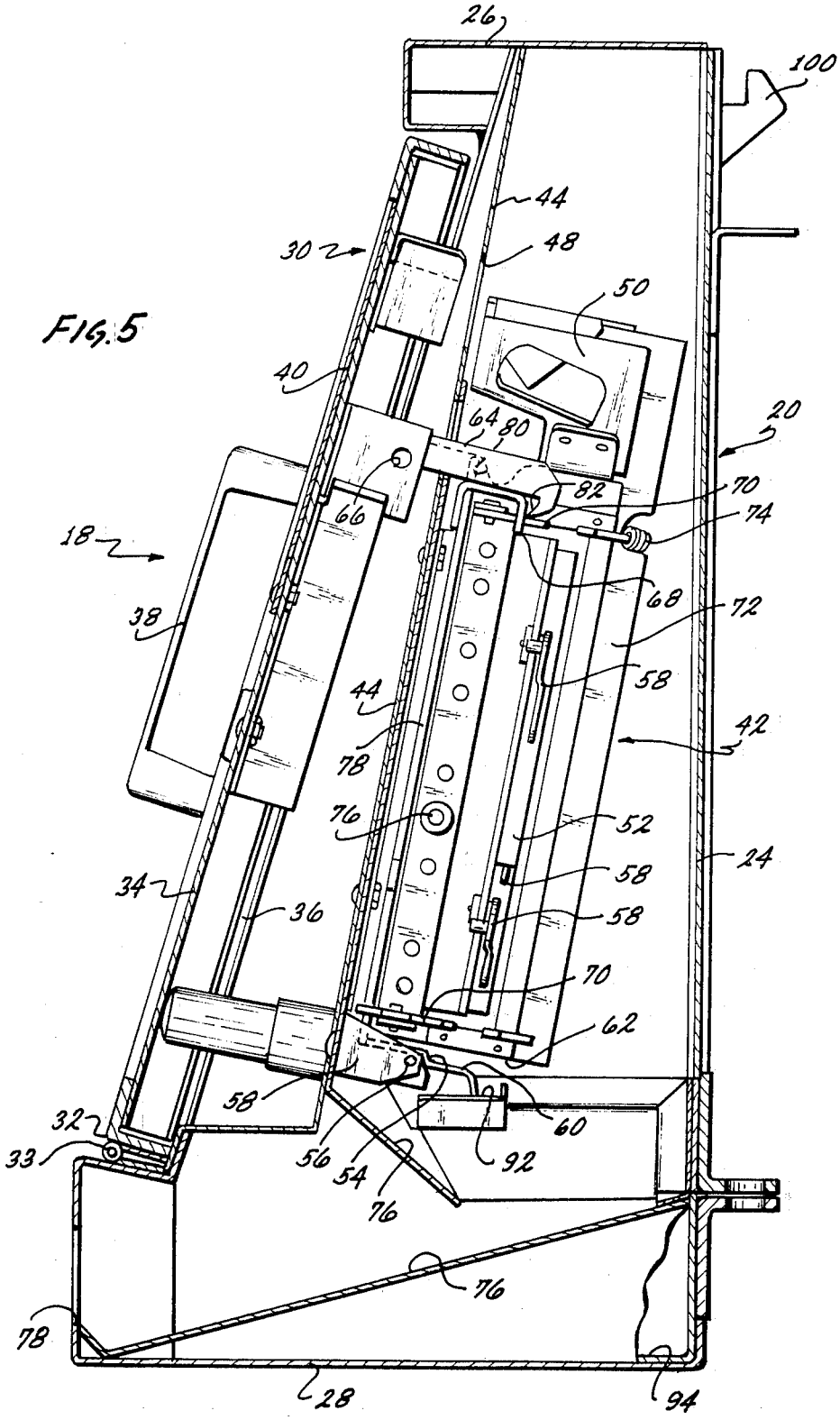
FIG. 5 is an elevational section taken along line 5—5 of FIG. 3 and showing the coin receiving and selecting mechanism and its interrelationship with the door locking mechanism.

As better appreciated in FIG. 5, a pivot bar 54 is mounted at pin 56 for pivotal movement in a vertical plane relative to a support bracket 58. A coin seat 60 is formed at one end of the pivot bar 54 underlying the open lower end 62 of the coin chutes 52. When a proper combination of coins is deposited into the coin mechanism 42, the lowermost coin or coins in the coin mechanism 42 will rest on the coin seat 60 while the uppermost coin in each coin chute 52 will be held against upward movement by a pawl 58. The coins are thus wedged between the coin seat 60 and the coin mechanism 42.

A latch member 64 is pivotably mounted by pin 66 to a bracket affixed to the front access door 30 and is spring loaded by spring 67 downwardly into locking engagement with a keeper member 68. The coin mechanism as originally disclosed in my previously cited U.S. Pat. No. 4,183,426, includes one or more pairs of spring arms 70 which are rotatably supported in a manner disclosed in my said patent for rotation in an outward direction away from a wall 72 common to both coin chutes 52. The upper pair of spring arms 70 is shown connected by a coil spring 74 urging the spring arms in the direction of the common wall 72. The keeper 68 is pivotably mounted at its lower end to the common wall 72 of the coin mechanism at pivot point 76, and has an upper end shaped as an inverted "U" channel, as seen in FIG. 5, the downwardly extending rear lip of the U channel being bifurcated to engage the spring arms 70. When an attempt is made to open the access door 30 the latch member 64 will engage the keeper member 68, causing the keeper to undergo a movement towards the door which is imparted to the coin chutes 52 through the spring arms 70 to cause the chutes to undergo rotational movement in a direction away from the common wall 72. This coin reject mechanism has the effect of opening the chutes throughout the length thereof releasing any coins or foreign matter in the chutes. The rejected coins are permitted to fall onto inclined baffle members 76 which conduct the coins to a coin return opening 78 in the front of the bottom member 28 of the frame 20 such that the return of coins may be retrieved by a customer.

Figure 6:
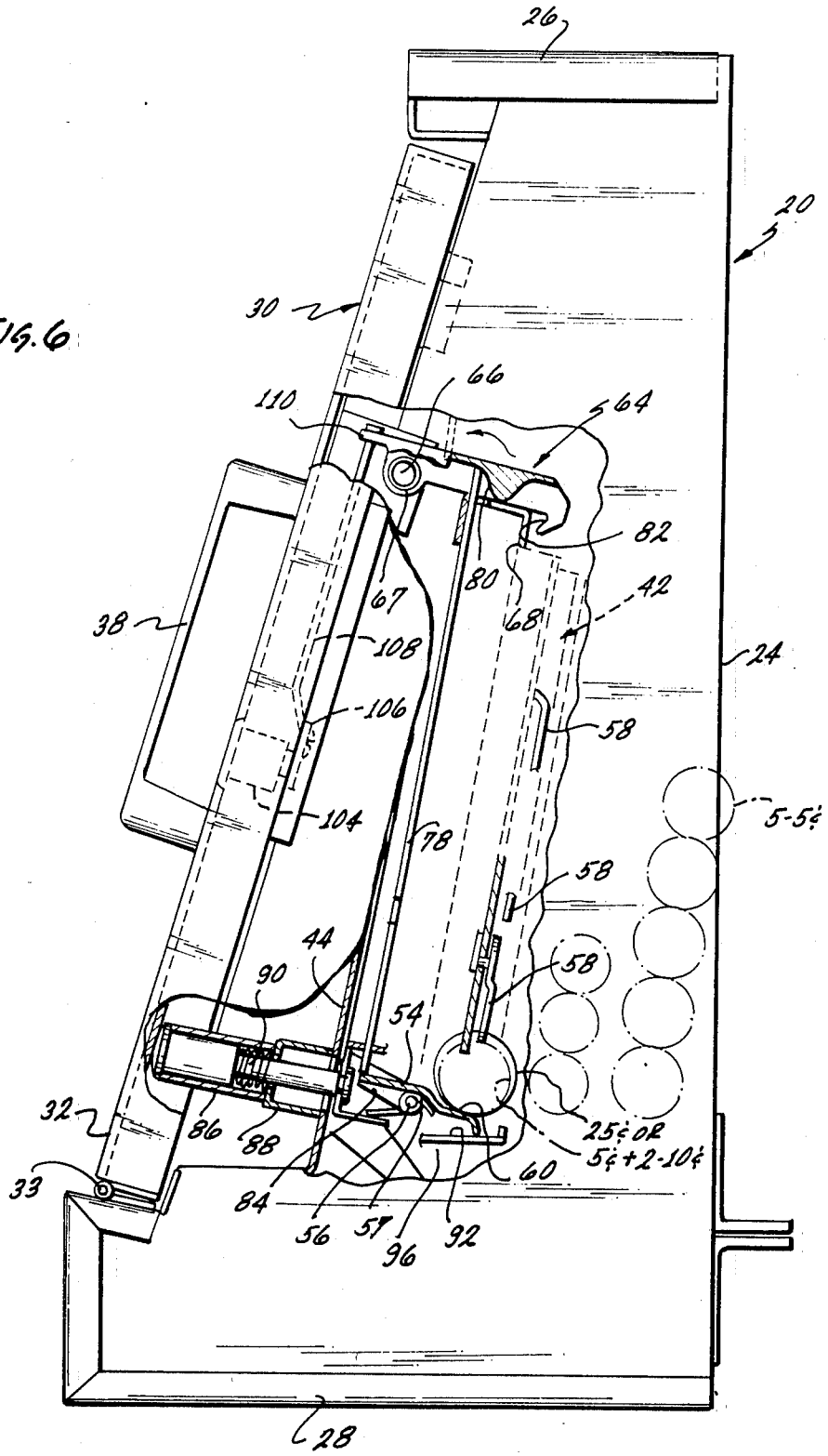
FIG. 6 is an elevational side view of the module of FIG. 3 partly broken away to illustrate the operation of the latch release mechanism by different combinations of coins inserted into the coin selecting mechanism of the module.

A latch release rod 78 extends upwardly alongside the coin mechanism 42 and is mounted thereto for sliding movement. The rod 78 has a lower end which rests on the pivot bar 54 at the end opposite to the coin seat 60. The upper end of the rod 78 passes through an opening in the upper end of the keeper 68 and enters the bottom of the latch member 64. The latch member may be an inverted U channel in cross section and in its interior is formed a camming surface 80. The free end of the latch member 64 includes downwardly extending hook elements 82 formed as part of the parallel side walls of the U cross section. The elements 82 are shaped to engage the keeper member 68 but are spaced from the keeper when the door is closed so as to allow a limited opening movement of the access door 30 before locking engagement of the latch member occurs. As an attempt is made to open the door, the camming surface 80 of the latch member 64 moves against the upper end of the rod 78. If the proper coinage has not been deposited into the mechanism 42, the rod 78 yields to the camming surface 80 by moving downwardly, depressing one end of the pivot bar 54 and consequently raising the coin seat 60 towards the bottom 62 of the coin chutes 52. If, however, the proper coinage has been deposited into the coin mechanism, the coins will be disposed in columnar relationship in the coin chutes 52 and locked against upper movement in the coin chutes by the pawls 58 as has been explained. The lowermost coin or coins being thus wedged against the coin seat 60, the pivot bar 54 is locked against pivotal movement, such that the latch release rod 78 is forced into camming engagement with the camming surface 80, lifting the latch member 64 out of locking engagement with the keeper 68 as the door 30 is opened. The aforedescribed operation of the latch release mechanism is best understood by reference to FIG. 6 where different combinations of coins are shown in columnar relationship and correlated with corresponding pawls 58. The lowermost pawl 58 is positioned and dimensioned to engage the upper edge of either a twenty-five cent coin or a nickel coin, there being a small difference in the diameter of these coins and the mechanism being so constructed as to tolerate some play in the coin when urged upwardly by the pivot bar 54 as an attempt is made to open the axis door 30. The intermediate pawl 58 only partially seen in the drawings is positioned for engaging a column of three dimes, while the uppermost pawl 58 wedges a column of five nickels against upward movement in the coin chute. It will be understood that these particular coin combinations are only illustrative and the pawls 58 may be constructed and positioned to engage many different coin combinations against upward movement in the coin chutes.

The pivot bar 54 is mounted on a pin 56 which is supported between aligned slots 84 in a bracket 86 affixed to the frame 20. The pivot pin 56 supporting the pivot bar 54 is spring loaded by means of spring 57 shown in FIG. 6 so as to bias the rod 78 into engagement with the latch member 64. The latch member is mounted for pivotal movement by a pin 66 and is downwardly biased by a spring 67 into engagement with the keeper 68. The spring 67 of the latch member is selected so that it prevails over the spring 57 of the pivot bar to ensure that the latch release rod 78 normally yields to the camming surface 80 in the absence of coinage wedged against the coin seat 60.

A plunger 86 is mounted for sliding movement within a coaxial collar 88 affixed to the front panel 44 of the coin mechanism housing. The plunger 86 is spring loaded by a coil spring 90 towards an extended position away from the coin mechanism 42. The plunger 86 is, however, kept in a depressed condition, i.e. the spring 90 is compressed when the access door 30 is in the closed position illustrated in FIG. 6. The inner end of the plunger 86 supports the bracket 58 which is attached to the pivot pin 56 of the pivot bar 54. When the access door 30 is opened, the plunger 86 is released towards its extended position under the urging of spring 90, moving the pin 56 within the elongated slots 84. The pivot bar 54 is consequently carried by the plunger, thus removing the coin seat 60 from under the wedged coinage. The dimensions of the pivot bar 54 are such that the coin seat 60 remains wedged under the coinage as the plunger begins to extend itself in respone to opening movement of the door sufficiently long to ensure camming engagement of the upper end of latch release rod 78 with the cam surface 80 to thereby raise the latch member 64 out of locking engagement with the keeper 68. Since the door is hinged along its lower edge 32, the distance moved by the latch member 64 which is mounted to the door at a radially outer point relative to the plunger 86, is greater than the extension achieved by the plunger 86 for a given arc of movement of the door 30, so that the latch member can be lifted clear of engagement with the keeper 68 while the pivot bar 54 has traveled a relatively short distance with the plunger 86 and the coin seat 60 is still held down by he wedged coinage. After the engaging elements 82 of the latch member have cleared the keeper 68 and the access door 30 is moved to a fully open position, thus freeing the plunger 86 to move in response to the urging of the spring 90, the pivot bar 54 is carried by the plunger out from underneath the bottom end 62 of the coin chutes, allowing the wedged coinage to drop free of the coin mechanism 42 into a coin receiving opening 92 underneath the pivot bar 54. The opening 92 is formed in the inclined baffle 76 and disposed above a coin box 94 which may be a drawer slidably fitting into the bottom of the coin mechanism housing 24 as shown in FIGS. 4 and 5.

At the bottom of the coin mechanism housing 24 are inclined baffles 76 in a generaly funnel configuration covering the coin box 94 so that any coins dropping out of the coin chutes when they are opened along their full length by the coin reject mechanism described earlier, the rejected coins are directed by the baffles through a chute defined by the baffles to the coin return opening 78. The coin receiving opening 92 which underlies the bottom of the coin chutes and receives the proper coinage sorted by the mechanism 42 may be surrounded by upwardly extending walls which keep rejected coinage sliding along the inclined baffles 76 from entering the opening 92 and falling into the coin box 94. The coin box 94 may be secured to the mechanism housing 24 by means of a key-operated lock 98 which is accessible to an operator only after the module 18 has been removed from the vending machine enclosure 12.

The module 18 may be locked to the enclosure 12 by a spring operated latch 100 which catches a downwardly extending lip affixed to the ceiling of the vending machine enclosure 12, and by a pair of key operated locks mounted to the bottom member 28 of the frame 20 on the inside such that the access door 30 must be opened before a key may be inserted into each of the locks 102. The locks are actuated to withdraw a bolt member which fits into receptacles formed in appropriate lugs affixed to the floor of the vending machine enclosure 12, thus allowing the latch 100 to be manually disengaged so that module 18 to be withdrawn from the enclosure.

Desirably, a key operated latch release mechanism is provided which is actuatable by an operator independently of the coin operated latch release mechanism already described. The key operated latch release may include a key operated lock 104 mounted to the door 30, a lever 106 which is rotatable by a proper key inserted in the lock 104, and a linkage rod 108 connecting the radially outer end of the rotatable lever 106 to the end 110 of the latch member 64. Thus, when a key is inserted into the lock 104 and rotated, the radially outer end of the lever 106 rotates downwardly, the linkage rod 108 thus depressing the end 110 of the latch member. The effect is to raise the opposite end 82 of the latch member to clear the keeper 68, thus permitting an operator to open the access door 30.

Figure 7:
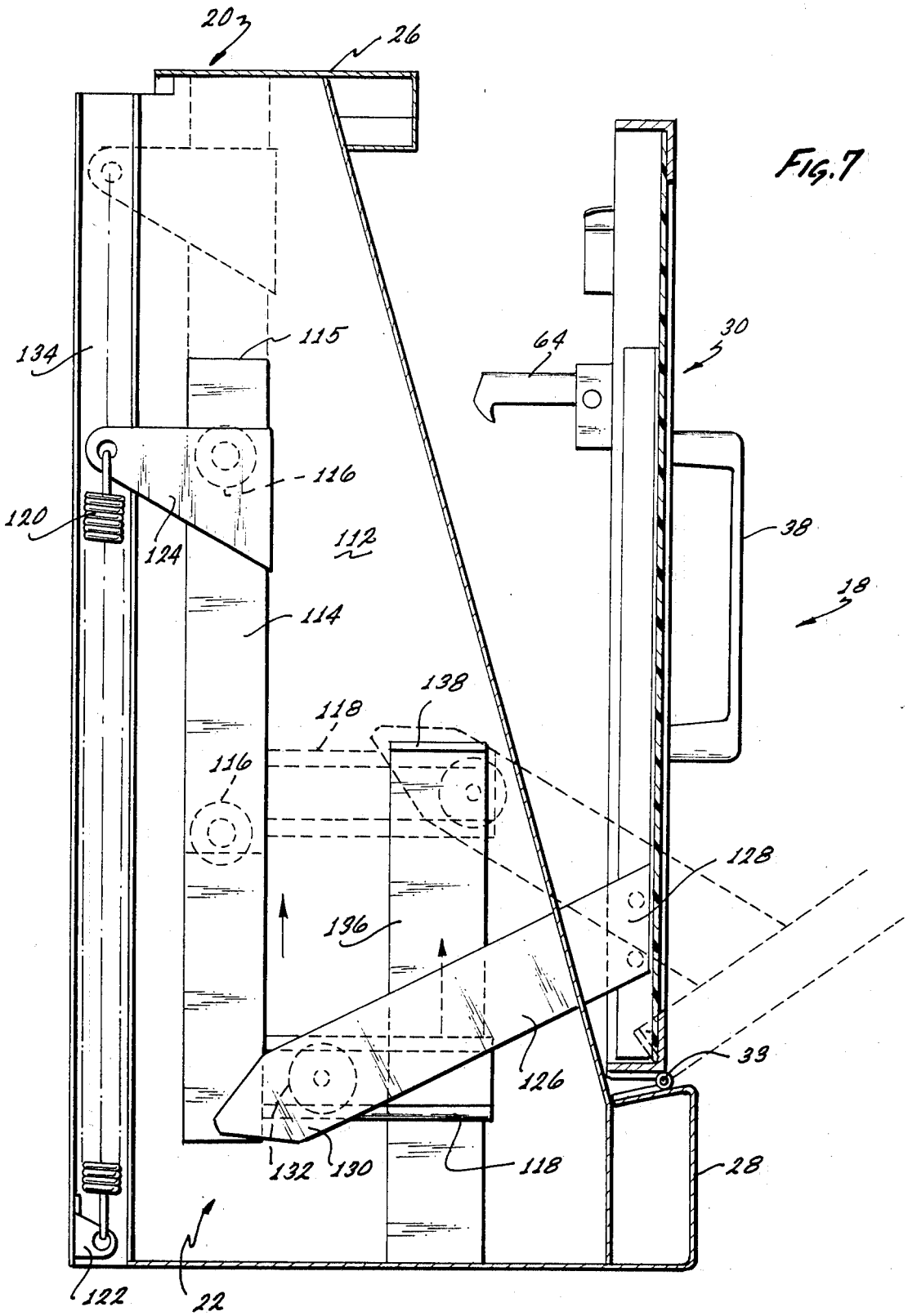
FIG. 7 is an elevational section taken along line 6—6 of FIG. 3 showing the spring operated door return mechanism.

The access door 30 is normally urged towards the closed position by means of a door return spring mechanism 22 best seen in FIG. 7. The spring mechanism includes a wall surface 112 which is perpendicular to the axis of the hinge 33 of the axis door. A first rail member 114 is mounted to the wall 112 for sliding movement along a fixed vertical line defined by a pair of guide wheels 116 rotatably mounted to the wall 112 and captive within the rail member 114. A second rail member 118 is affixed at a right angle to the first rail member 114 and is slidable therewith as a unit along the aforesaid line. A door spring 120 which may be a coil spring is supported between an anchor 122 affixed to the module frame 20 and an anchor member 124 affixed to the slidable member 114. An arm 126 is affixed at one end 128 to the door 30 preferably near the lower edge 32 of the door. The opposite end 130 of the arm 126 carries a guide wheel 132 rotatably mounted to the arm 126 and captive within the second rail member 118. With the access door 30 at or near closed position the arm 126 slopes downwardly away from the door as shown in solid lining in FIG. 7 and the right angle rail unit 116, 118 is at its lowermost point as determined by the position of the captive wheel 132. In this state the coil spring 120 is at minimum distension between the two anchors 122 and 124.

If the access door 30 is now opened, the arm 126 swings therewith so that the wheel 132 moves in an upward arc to a position shown in phantom lining in FIG. 7. Since the wheel 132 is captive to the rail member 118, the rail member 118 is carried upwardly by the wheel 132, causing the first rail member 114 to slide upwardly along the two guide wheels 116. Simultaneously, the wheel 132 moves in a straight line from left to right in FIG. 7 within the rail 118. It will be appreciated that the net effect of the mechanism is that the arcuate trajectory of the wheel 132 resulting from opening or closing movement of the door 30 is decomposed into a pair of component vectors along the two rail members 114 and 118. A first component vector is horizontal along the rail 118 and has no effect on the tension of spring 120. The other component vector is represented by the vertical movement of the first rail member 114 to the higher phantom position. The upward movement of the anchor 124 resulting from the sliding displacement of the rail member 114 stretches the spring 120 such that the stretched spring now urges the rail member 114 to its beginning bottom position. The spring force of the stretched return spring 120 is transmitted through the rigidly connected rail members 114 and 118 to the captive wheel 132, thus urging the raised arm 126 downwardly so as to swing the door 30 upwardly about the hinge 33 and return the door to its closed position against the frame 20. The door spring mechanism fits within a relatively narrow housing at one end of the module 18, and is of simple construction and reliable in operation. The spring is protected by a spring compartment 134 so that newsprint stacked in the vending machine doesn't get caught in the spring and also to prevent possible injury by the taut spring to customers and operators alike who reach into the device. Further, the spring 120 is stretched along a fixed straight line rather than having to follow the arcuate movement of the door or any member directly connected to the door 30 which would result in an arcuate component in the movement of the spring with a possible reduction in the service life of the spring. A further advantage of the door spring mechanism disclosed herein is that the mechanism connects to the pull down door 30 at a point relatively near to the bottom hinge 33 so as to leave substantially unobstructed the opening defined between the door 30 and the frame 20. A still further advantage is that the mechanism, allows the use of a relatively long spring 120, so as to take advantage of the full height of the frame 20, yet interconnecting the mechanism to a pull down door at a point near the bottom hinge 33. The use of a longer spring 120 increases the reliability, smoothness, and strength of the spring mechanism.

A strip 136 may be fixed flat against the wall surface 112 and bent at its upper end so as to form a lip 138 projecting from the wall surface 112 to act as a stop member for the horizontal rail 118, thus limiting the upward movement of the right angle rail unit as well as supporting the door 30 at a maximum open position determined by the stop member 138. The dimensions of the mechanism may be such that the upper end 115 of the vertical rail member 114 abuts against the underside of the top member 26 of the frame 20 simultaneously with the horizontal rail 118 stopping against the lip 138 to thus more uniformly distribute the impact on the right angle rail structure and prevent deformation thereof when the access door 30 is repeatedly pulled open with excessive force by consumers.

It must be understood that many alterations and modifications may be made by those having ordinary skill in the art to the structure of the present invention without deeparting from the spirit and scope of the invention. Therefore, the presently illustrated embodiment has been shown only by way of example and for the purpose of clarity and should not be taken to limit the scope of the following claims.

I claim:

1. A pull down door assembly and coin mechanism for a vending machine comprising:

a frame;

a pull down door having a lower edge hingedly mounted to said frame for movement between a closed and an open position;

latch means including a camming surface affixed to an upper portion of said door for normally releasably locking said door against opening;

coin seat means;

a coin receiving and sorting mechanism disposed intermediate said latch means and said coin seat means for wedging proper coinage against said coin seat means;

a rod mounted for normally yielding to said camming surface when an attempt is made to open said door; and means cooperating with coinage and wedged against said coin seat means so as to urge said rod into camming engagement with said camming surface in response to opening movement of said door thereby biasing said latch means out of locking engagement to allow opening of said door.

2. The apparatus of claim 1 wherein said coin receiving and sorting mechanism further comprises coin reject means actuated by said latch member when opening force is applied to said access door in the absence of coinage wedged against said coin seat means.

3. The apparatus of claim 1 further comprising coin reject means including a keeper member engageable by said latch member for locking said door to said frame, said keeper member being movable by said latch member for actuating said coin reject means responsive to opening movement of said door in the absence of coinage wedged against said coin seat means, said latch member being cammed out of engagement with said keeper member by said latch release means in the presence of coinage wedged against said coin seat means.

4. The apparatus of claim 3 further comprising coin return opening in said frame accessible to a consumer and coin return chute means for directing rejected coins to said coin return opening.

5. The apparatus of claim 1 wherein said coin receiving and sorting apparatus comprises:

a coin receiving and transfer chute, pawl means extending into said chute at a predetermined position thereto;

means for opening said chute throughout the length thereof to reject the coins therein when said opening means is actuated by engagement with said latch member as a consumer attempts to open said door unless the proper coinage is wedged between said coin seating means and said pawl means.

6. The apparatus of claim 5 wherein said coin sorting and receiving means also includes means for adjustably supporting said pawl means relative to said coin seating means in such a relationship as to allow preselected coinage to become wedged therebetween as said door is opened.

7. The apparatus of claim 5 wherein said coin sorting and receiving means comprises:

a central wall member and a pair of side wall members movable relative to said central wall member, each of said pair of side wall members cooperatively related to said central wall member to define a separate coin receiving and transfer chute.

8. The apparatus of claim 7 wherein said central wall member includes:

means defining an access opening between said chutes, and said side wall members include:

means defining access openings between the exterior and interior of each of said chutes, and said pawl means include:

fingers extending through at least one of said side wall member access openings.

9. The apparatus of claim 8 wherein said pawl means also includes: secondary finger means extending through said central wall access opening and into the chute on the opposite side thereof whereby said pawl finger is acted upon by coins in one of said chutes and said secondary pawl finger is acted upon by coins in the other of said chutes.

10. The device of claim 1 wherein said coin receiving and sorting mechanism comprises:

a coin receiving and transfer chute;

said coin sorting means including pawl means extending into said chute at a predetermined position relative thereto;

keeper means normally engageable by said latch means for releasably locking said door against opening;

means for opening said chute throughout the length thereof to reject the coins therein actuatable by movement of said keeper means as a consumer attempts to open said door if proper coinage is not wedged between said coin seating means and said pawl means.

11. The device of claim 10 wherein said latch means is mounted to said door for movement away from engagement with said keeper means, said camming surface on said latch means biasing the latch means away from said keeper when the proper coinage is wedged between said pawl means and said coin seating means as a consumer attempts to open said door.

12. The device of claim 1 further comprising key operated means for urging said latch means out of locking engagement.

13. A pull down door assembly and coin mechanism for a vending machine comprising:

a frame;

a pull down door having a lower edge hingedly mounted to said frame for movement between a closed and an open position;

latch means affixed to an upper portion of said door for normally releasably locking said door against opening;

a coin receiving and sorting mechanism disposed intermediate said latch means and said coin seat means for wedging proper coinage against said coin seat means;

a plunger mounted to said frame and spring loaded towards an extended position, said door in its closed position holding the plunger depressed against said spring loading;

lever means pivotably mounted to said plunger:

a coin seat on said lever means and underlying said coin receiving and sorting mechanism;

a camming surface on said latch member; and a rod normally yielding to said camming surface during opening movement of said door, said lever means being held against pivotal movement by coinage wedged against said coin seat by said coin sorting mechanism to thereby urge said rod into camming engagement with said camming surface, thus biasing said latch means out of locking engagement to allow opening of said door, said lever means being carried by said plunger towards said extended position upon opening of said door to allow wedged coinage to drop free of said coin sorting mechanism.

14. The apparatus of claim 13 wherein said rod is slidably mounted to said frame.

15. The apparatus of claim 13 wherein said latch means in locking engagement with said frame allows limited opening movement of said door to bring the camming surface on said latch means into engagement with said rod.

16. The apparatus of claim 15 further comprising spring means urging said door towards said closed position.

17. A door return spring mechanism for a door hinged to a frame for movement between an open and a closed position comprising:

a first member movable along a fixed direction in a plane perpendicular to the hinge axis of said door between a first position and a second position associated with an open and a closed door position respectively;

spring means mounted between said frame and said first member;

rail means extending within said plane and fixed in perpendicular relationship to said fixed direction of said first member; and an arm extending from said door and having an end captive for sliding movement along said rail means;

said first member, said rail means and said arm constructed and configured such that opening movement of said door and the consequent arcuate motion of said captive arm end relative to said frame is resolved into linear motion of said captive end along said rail means and sliding movement of said first member against said spring means.

18. The device of claim 17 further comprising: a stop means on said frame positioned for limiting movement of said first member during opening movement of said door to thereby define a fully open position of said door.

19. The device of claim 17 wherein said arm is affixed to said door near said lower hinged edge so as to minimize obstruction to access when said door is open.

20. The device of claim 17 wherein said arm is affixed near one side edge of said door.

21. The device of claim 17 wherein said spring means is a coil spring anchored at one end to said frame and to said first member at its other end the axis of said coil spring lying parallel to said fixed direction.

22. The device of claim 17 wherein said first member is a first channel member slidably mounted to said frame by means of a plurality of guide wheels captive within said channel; and said rail means is a second channel member affixed at an angle to said first channel member and holding captive a wheel mounted to said captive end of said arm.

23. The device of claim 17 further comprising means defining a spring compartment about said spring.

24. A door return spring mechanism for a door hinged to a frame for movement between an open and a closed position comprising:

a first channel member slidably mounted to said frame by means of a plurality of guide wheels captive within said channel in a plane perpendicular to the hinge axis of said door between a first position and a second position associated with an open and a closed door position respectively;

spring means mounted between said frame and said first channel member and normally bringing said first channel member towards said second position;

an arm extending from said door and having a wheel mounted on one end;

a second channel member affixed at an angle to said first channel member and holding captive said wheel mounted on said arm;

said first channel member, said second channel member and said arm constructed and configured such that opening movement of said door and the consequent arcuate motion of said captive arm end relative to said frame is resolved into linear motion of said captive end along said second channel member and sliding movement of said first channel member against said spring means.

* * * * *